US011610715B2

(12) United States Patent
Schumm et al.

(10) Patent No.: US 11,610,715 B2
(45) Date of Patent: Mar. 21, 2023

(54) IGNITION COIL AND METHOD FOR THE MANUFACTURE OF AN IGNITION COIL

(71) Applicant: BorgWarner Ludwigsburg GmbH, Ludwigsburg (DE)

(72) Inventors: Sven Schumm, Walheim (DE); Manfred Adolf, Schwaikheim (DE); Timo Stifel, Stuttgart (DE); Dirk Wüstenhagen, Auma (DE); Manuel Bauer, Ludwigsburg (DE); Alexander Stark, Althengstett (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 582 days.

(21) Appl. No.: 16/384,258

(22) Filed: Apr. 15, 2019

(65) Prior Publication Data

US 2019/0318861 A1 Oct. 17, 2019

(30) Foreign Application Priority Data

Apr. 17, 2018 (DE) ..... 10 2018 109 050.1

(51) Int. Cl.

| | |
|---|---|
| ***H01F 27/02*** | (2006.01) |
| ***H01F 27/245*** | (2006.01) |
| ***H01F 38/12*** | (2006.01) |
| ***F02P 3/02*** | (2006.01) |

(52) U.S. Cl.

CPC ..... *H01F 27/022* (2013.01); *F02P 3/02* (2013.01); *H01F 27/245* (2013.01); *H01F 38/12* (2013.01)

(58) Field of Classification Search

CPC ..... H01F 27/022; H01F 27/245; H01F 38/12; F02P 3/02

See application file for complete search history.

(56) References Cited

U.S. PATENT DOCUMENTS

| | | | | |
|---|---|---|---|---|
| 2,568,167 | A * | 9/1951 | Prentiss | H04R 25/04 336/96 |
| 3,317,796 | A * | 5/1967 | Thompson | H01F 27/22 361/678 |
| 5,550,704 | A | 8/1996 | Morita et al. | |
| 2017/0040104 | A1 | 2/2017 | Akimoto | |
| 2017/0301461 | A1* | 10/2017 | Kato | H01F 38/12 |
| 2017/0330671 | A1* | 11/2017 | Athavale | H01F 27/025 |

FOREIGN PATENT DOCUMENTS

| | | | |
|---|---|---|---|
| CN | 204 167 075 U | | 2/2015 |
| CN | 205 104 353 U | | 3/2016 |
| CN | 205104353 U | * | 3/2016 |
| CN | 106 158 318 A | | 11/2016 |
| DE | 38 11 842 A1 | | 10/1989 |
| DE | 195 06 589 A1 | | 8/1995 |
| EP | 0 031 576 A1 | | 7/1981 |

* cited by examiner

*Primary Examiner* — Tuyen T Nguyen
(74) *Attorney, Agent, or Firm* — Bose McKinney & Evans LLP

(57) ABSTRACT

An ignition coil is described for an internal combustion engine, with a housing, a transformer, which is arranged in an interior space of the housing, and potting compound, with which the interior space of the housing is cast. In accordance with this disclosure provision is made for the transformer to be covered by a mat, which is embedded in the potting compound.

11 Claims, 1 Drawing Sheet

IGNITION COIL AND METHOD FOR THE MANUFACTURE OF AN IGNITION COIL

RELATED APPLICATIONS

This application claims priority to DE 10 2018 109 050.1, filed Apr. 17, 2018, the entire disclosure of which is hereby incorporated herein by reference.

BACKGROUND

This disclosure relates to an ignition coil of the type generally known, for example, from U.S. Publication No. 2017/0040104 A1.

In the manufacture of such ignition coils, a transformer is arranged in a housing, which is then potted with a potting compound and thus filled. When such ignition coils are used, mechanical and thermal stresses can cause cracks in the potting compound, which grow over time and can reach the surface. Moisture can then pass through these cracks and lead to a failure of the ignition coil.

SUMMARY

This disclosure demonstrates a way in which the risk of failure of an ignition coil due to cracking can be reduced.

In the inventive ignition coil, a mat is embedded into the potting compound, which forms a barrier to crack propagation. Cracks form mainly at edges and corners, for example at the edges of an iron core of the transformer. A mat that covers the transformer has at best little influence on the crack formation at such sites, but represents a barrier for crack growth, so that cracks can no longer propagate up to the surface of the potting compound as easily as is the case for conventional ignition coils. As long as cracks do not lead up to the surface of the potting compound, they cannot significantly impair the potting and insulating function of the potting compound, and therefore do not lead to a premature failure of the ignition coil.

In the manufacture of an inventive ignition coil, a transformer is first inserted into a housing, the transformer is then covered by one or more mats, and the housing is then potted with potting compound, whereby the transformer and the mat(s) are embedded into the potting compound. The mat may be attached to the transformer or housing before the potting compound is poured, for example by means of gluing or clamping, in order to keep the mat from floating on the potting compound when the potting compound is filled into the housing. In order to clamp the mat into the housing, a separate component can be inserted into the housing, such as a frame. Such a frame can be clamped into the housing, that is to say, held in position by friction forces, or latched onto undercuts or projections of the housing.

The mat can, for example, be a woven fabric mat, a mat of non-woven material, a fiber mat or a foam mat. To make it easier for the mat to be penetrated by the potting compound during potting, it can be advantageous to use an impregnated mat, or a mat made of impregnated fibers. In this way it is easier to wet the mat with potting compound.

The potting compound can be, for example, an epoxy resin. The housing can be made of plastic, for example a thermoplastic or a duroplast. The housing can form a cup into which the transformer is inserted, and after potting can be closed by a lid. However, the lid can also be dispensed with, especially if the housing is filled up to the rim with potting compound.

In an advantageous refinement of this disclosure provision is made for the mat to have one or more cut-out through holes, e.g., slits. If the transformer is covered with such a mat, the potting compound can penetrate into the interior of the housing more quickly during potting, and air displaced by the potting compound can escape even better. The reason for this is that the potting compound can penetrate into the interior of the housing faster through cut-out holes(s) than through pores or fiber interstices in the mat.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following description. Rather, the embodiments are chosen and described so that others skilled in the art may appreciate and understand the principles and practices of this disclosure.

Figure 1:
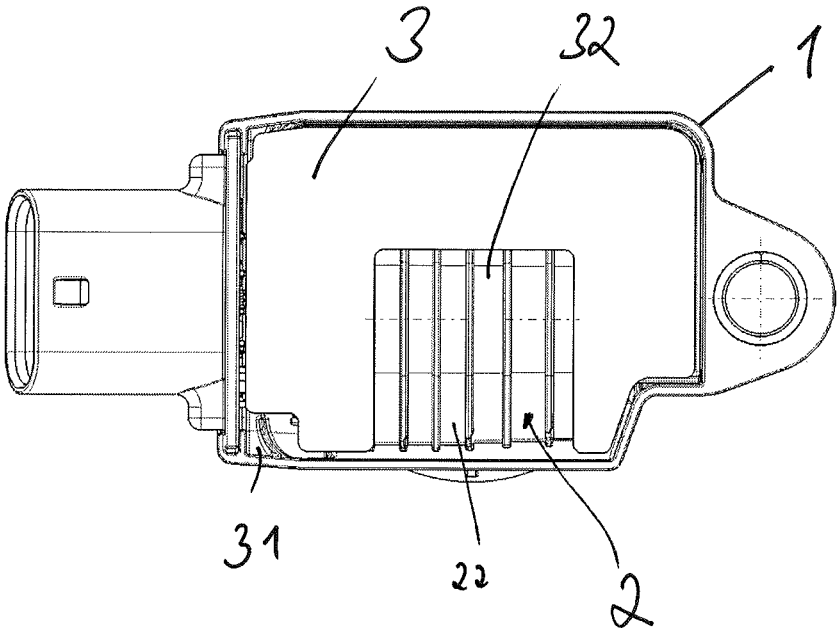
FIG. 1 shows an example of embodiment of an ignition coil before potting.
Figure 2:
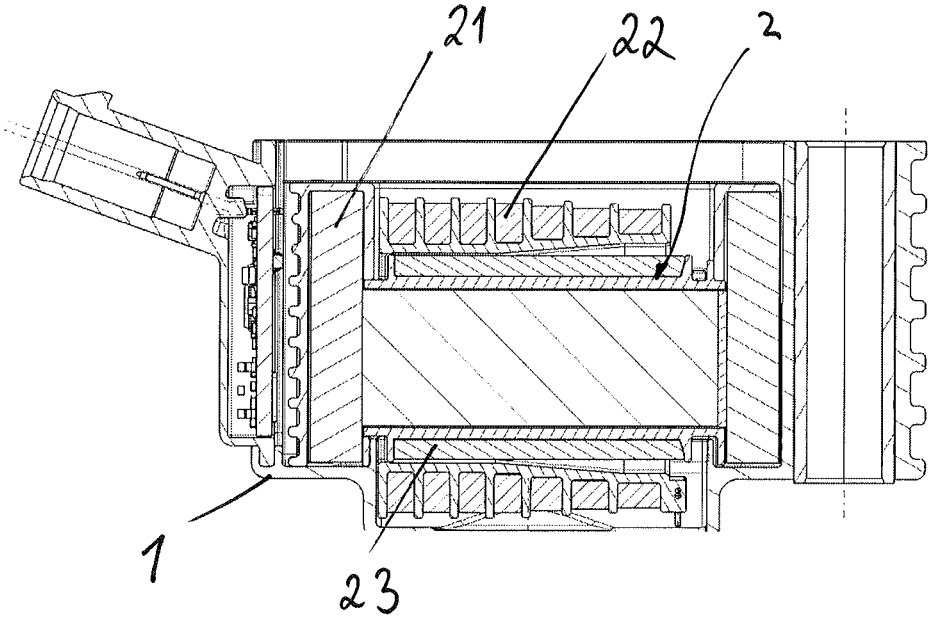
FIG. 2 shows the ignition coil in a cross-sectional view.

In FIG. 1 an ignition coil is shown in a plan view before potting, and in FIG. 2 it is shown in a corresponding cross-sectional view. The ignition coil has a housing 1 in which a transformer 2 is inserted. The transformer 2 can have an iron core 21, and primary and secondary windings 22, 23. After insertion of the transformer 2 into the housing 1, the transformer 2 is covered with a mat 3. The mat 3 can be, for example, a woven fabric mat, a mat of non-woven material, a fiber mat, or a foam mat.

The interior of the housing 1 is then filled with the potting compound, e.g., an epoxy resin. In this way, the interior of the housing 1 is potted in a sealed and insulated manner, and the transformer 2 and mat 3 are embedded in the potting compound.

After potting, the pores or fiber interstices of the mat 3 are filled with the potting compound, and the transformer is enclosed in the potting compound. The mat 3 is thus penetrated by the potting compound. The mat 3 can be pre-impregnated, e.g., with a resin, so that it is more easily wetted by the potting compound, and a good and void-free bonding between the potting compound and the mat 3 is reliably created.

In order that the mat 3 does not float on the potting compound as the potting compound is filled into the housing, the mat can be attached to the transformer 2 or the housing 1 before the potting compound is poured, for example by gluing or clamping. However, it is also possible to provide inwardly projecting rib projections on an inner side of the housing that hold the mat down. Alternatively or additionally, it is possible to hold the mat in position during potting by means of stamps or other hold-down devices and to pull the stamps or hold-down devices out of the housing 1 before the potting compound solidifies. It is also possible to attach the mat to the housing wall or transformer using an additional plastic frame, for example by snapping, clipping or tensioning the additional frame into position.

In order to accelerate the penetration of the potting compound into the interior of housing 1 and to facilitate the escape of the air displaced by the potting compound, mat 3 can have one or a plurality of cut-out through holes 31, 32. For example, one through hole 31 can serve as a pouring opening through which the potting compound is filled into the interior of the housing, and another through hole 32 can serve as a vent opening through which air displaced by the potting compound exits.

In the example of embodiment shown, the mat 3 covers corners and edges of the transformer 2. Due to mechanical and thermal loads, corners and edges of the transformer can become the sources of cracks in the potting compound to a particularly high degree. If cracks form in the potting compound during operation of the ignition coil, these can essentially only propagate in the potting compound as far as the mat 3 embedded in the potting compound. The mat 3 forms a barrier to cracks, preventing cracks from propagating to the surface of the potting compound. The mat 3 embedded in the potting compound thus ensures that the sealing and insulating action of the potting compound is maintained for a longer period of time.

In the embodiment shown, only one mat 3 is shown. Instead of a single mat 3, however, a plurality of mats 3 can also be used, which cover different regions of the transformer and can partially overlap each other. In particular, it is also possible to place a plurality of mats 3 on top of each other on the transformer 2 in order to make the propagation of cracks in the potting compound even more difficult.

The cup-like plastic housing 1 can be used advantageously without a lid by filling it with potting compound up to its upper edge.

While exemplary embodiments have been disclosed hereinabove, the present invention is not limited to the disclosed embodiments. Instead, this application is intended to cover any variations, uses, or adaptations of this disclosure using its general principles.

Further, this application is intended to cover such departures from the present disclosure as come within known or customary practice in the art to which this invention pertains and which fall within the limits of the appended claims.

LIST OF REFERENCE SYMBOLS

1 Housing
2 Transformer
3 Mat
21 Iron core
22 Transformer winding
23 Transformer winding
31 through hole
32 through hole

What is claimed is:

1. An ignition coil for an internal combustion engine, comprising:

a housing;

a transformer which is arranged in an interior space of the housing;

a potting compound with which the interior space of the housing is potted;

wherein the transformer is covered by a mat which is attached to the housing or the transformer and the mat is embedded in the potting compound; and wherein the mat comprises a plurality of mats which are positioned on top of each other, the plurality of mats being positioned to cover different regions and the transformer, and being at least partially overlapping with each other.

2. The ignition coil according to claim 1, wherein the mat is a woven fabric mat, a mat of non-woven material, a fiber mat, or a foam mat.

3. The ignition coil according to claim 1, wherein the potting compound is an epoxy resin.

4. The ignition coil according to claim 1, wherein the mat has one or a plurality of cut out through-holes.

5. The ignition coil according to claim 1, wherein the mat covers edges of an iron core of the transformer.

6. The ignition coil according to claim 1, wherein the mat contains fibers, and fiber interstices of the mat are filled with potting compound.

7. An ignition coil for an internal combustion engine, comprising:

a housing;

a transformer arranged in an interior space of the housing;

a potting compound with which the interior space of the housing is potted;

wherein the transformer is covered by a mat which is embedded into the potting compound wherein the mat has first and second through holes cut into it with the first through hole forming an opening through which the potting compound is poured and the second through hole forming a vent opening.

8. The ignition coil according to claim 1, wherein the housing has a cup-like shape with an upper edge and wherein the potting compound fills the interior space of the housing to the upper edge of the housing.

9. The ignition coil according to claim 7, wherein the housing has a cup-like shape with an upper edge and wherein the potting compound fills the interior space of the housing to the upper edge of the housing.

10. The ignition coil according to claim 1, wherein the mat has first and second through holes cut into it with the first through hole forming an opening through which the potting compound is poured and the second through hole forming a vent opening.

11. The ignition coil according to claim 7, wherein the mat comprises a plurality of mats which are positioned on top of each other, the plurality of mats being positioned to cover different regions and the transformer, and being at least partially overlapping with each other.

* * * * *